United States Patent [19]

Wyner et al.

[11] 4,323,812

[45] Apr. 6, 1982

[54] ELECTRIC DISCHARGE LAMP

[75] Inventors: Elliot F. Wyner, Peabody, Mass.; Elvery D. Lowry, Hillsboro, N.H.

[73] Assignee: GTE Service Corporation, Stamford, Conn.

[21] Appl. No.: 127,720

[22] Filed: Mar. 7, 1980

[51] Int. Cl.[3] ..... H01J 61/54

[52] U.S. Cl. ..... 313/198; 313/185; 313/217

[58] Field of Search ..... 313/198, 220, 221, 184, 313/217, 185

[56] References Cited

U.S. PATENT DOCUMENTS

| | | | |
|---|---|---|---|
| 2,727,187 | 12/1955 | Webb et al. | 313/198 X |
| 3,377,498 | 4/1968 | Koury et al. | 313/221 |
| 3,610,983 | 10/1971 | Grabner | 313/184 X |
| 4,009,408 | 2/1977 | Nguyen Dat et al. | 313/198 |

*Primary Examiner*—Marvin L. Nussbaum

*Attorney, Agent, or Firm*—William H. McNeill

[57] ABSTRACT

A high pressure electric discharge lamp exhibits lowered starting voltages and improved lumen performance by utilizing within the arc discharge tube a starting probe that is electrically isolated at all times.

4 Claims, 2 Drawing Figures

ELECTRIC DISCHARGE LAMP

TECHNICAL FIELD

This invention relates to electric discharge lamps; i.e., lamps in which light (or radiant energy near the visible spectrum) is produced by the passage of an electric current through a vapor or gas. It has particular application to mercury vapor lamps and metal halide vapor arc lamps.

BACKGROUND ART

Lamps of the type described are known in the art. An exemplary lamp is the mercury discharge type. In such lamps light is produced by the passage of an electric current through mercury vapor. These lamps usually employ an outer envelope containing an inert gas or vacuum. An arc discharge tube is mounted within the outer envelope and contains first and second spaced apart main electrodes. The arc tube is hermetically sealed and contains the requisite amount of mercury together with a readily ionizable gas, such as argon, to improve starting.

To further improve starting performance, commercially available high pressure mercury lamps employ a starting probe which is an electrode sealed into the lamp adjacent to one of the main electrodes and electrically connected to the other of the main electrodes through a current limiting resistor.

In a low wattage mercury lamp application a ballast is employed which uses standard line voltage (120 V A.C.) connected through a current limiting inductance directly to the mercury lamp. This ballast provides a high voltage-low energy pulse which is sufficient to break down the gap between the main electrodes and, thus, no starting probe is required. It would be an advance in the art however, if better starting and better lumen maintenance could be provided for electric discharge lamps of the low wattage type.

DISCLOSURE OF INVENTION

It is an object of this invention to improve electric discharge lamps.

It is another object of the invention to enhance the starting capabilities of such lamps.

These objects are accomplished in one aspect of the invention by the provision of an electric discharge lamp which contains an arc tube. The arc tubes has first and second main electrodes and a starting probe adjacent one of them. The starting probe, however, is electrically isolated at all times from the circuitry of the lamp.

Lamps having the above-described construction have been shown to have starting voltages averaging 750 V less than similar lamps constructed without the probe. Furthermore, after an initial burn-in, the lamps of the invention have better lumen maintenance than similar lamps without the probe.

BEST MODE FOR CARRYING OUT THE INVENTION

For a better understanding of the present invention, together with other and further objects, advantages and capabilities thereof, reference is made to the following disclosure and appended claims taken in conjunction with the above described drawings.

Figure 1:
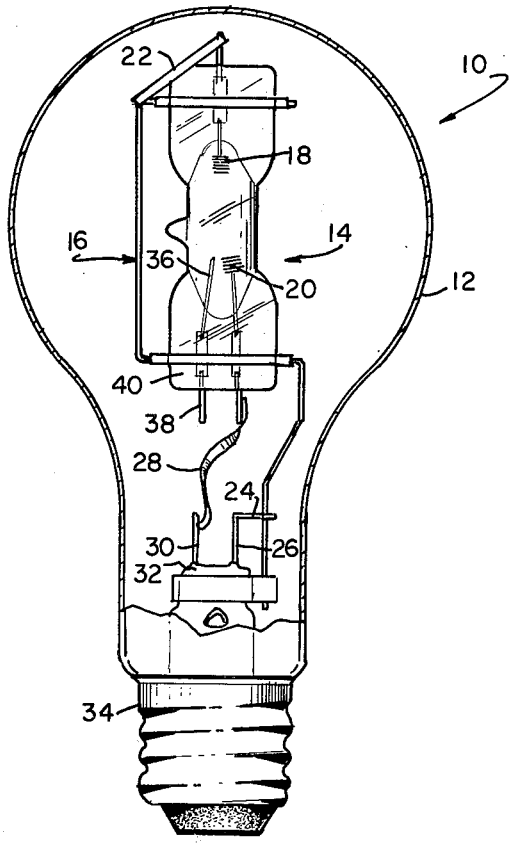
FIG. 1 is an illustration of the lamp of the invention.

Referring now to the drawings with greater particularity, there is shown in FIG. 1 a low wattage, high pressure electric discharge lamp 10 having an outer envelope 12 containing an inert gas, such as nitrogen, or a vacuum. When nitrogen or a similar gas is employed a pressure of about 350 Torr is preferred.

An hermetically sealed arc discharge tube 14 is mounted within envelope 12 by means of a suitable mount 16. Tube 14 contains first and second main electrodes 18 and 20 and an ionizable medium such as argon at a pressure of 50 Torr together with about 2.3 mg of mercury. Electrode 18 is conventionally connected to one side of a 120 V line source through connector 22, mount 16, connector 24 and lead-in wire 26. Electrode 20 is connected to the other side of a 120 V line source through connector 28 and lead-in wire 30. Lead-in wires 26 and 30 may be sealed in a glass press 32, as is conventional. Lamp 10 in this instance is provided with a screw-in base 34.

The improvement in the above-described lamp is epitomized by the electrically isolated starting probe 36 which is sealed into tube 14 adjacent one of the electrodes, for example, 20. The probe 36 is electrically isolated at all times; i.e., unlike the prior art probes, it is never connected to any of the circuitry of the lamp. The end portion 38 of probe 36 which projects beyond the seal area 40 of tube 14 is a mechanical convenience which allows the probe 36 to be held in position during the sealing operation. The preferred material for the probe 36 is tantalum.

The exact reason for the unexpectedly improved performance consisting of the lowered starting voltage and the improved lumen maintenance which occurs with the electrically isolated probe is unknown. Possible explanations are that the probe, when constructed of tantalum, is serving as a hydrogen getter, or that the probe may be serving to locally enhance the field at the electrode.

The lamp 10 is operated through a low wattage mercury lamp ballast wherein the standard line voltage is connected directly to the lamp through a current limiting inductance. This ballast further provides a high voltage-low energy pulse for starting the lamp.

The following table illustrates the dramatic reduction in starting voltages between aged lamps without a probe and aged lamps with the electrically isolated probe.

TABLE I

| Without Probe | | With Electrically Isolated Probe | |
|---|---|---|---|
| Lamp Number | Starting Voltage | Lamp Number | Starting Voltage |
| 1 | 1500 | 1p | 1000 |
| 2 | 1600 | 2p | 400 |
| 3 | 1400 | 3p | 700 |
| 4 | 1500 | 4p | 900 |
| 5 | 1500 | | |
| Average | 1500V | Average | 750V. |

The line voltage was 120 V A.C. and the aging time was 4000 hours.

Figure 2:
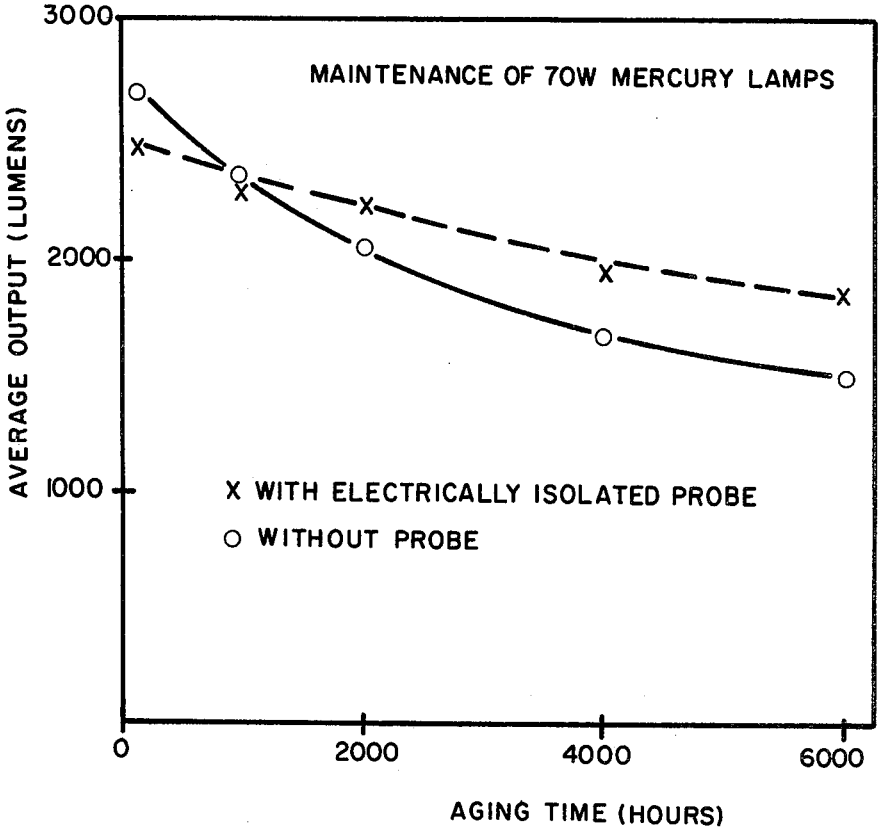
FIG. 2 is a graph plotting lumen maintenance of the lamp of the invention against a prior art lamp.

In referring to the graph of FIG. 2 it will be seen that, although initial lumens are higher in lamps without the probe, within 1000 hours better lumen performance is obtained with the lamp containing the electrically isolated probe.

In another test, with probe 36 electrically connected to electrode 18 through a current limiting resistor, it was visually observed that the energy of the pulse was dissipated across the gap between the probe and the adjacent electrode, thus reducing the ionization between the two main electrodes during the pulse and interferring with starting.

There is thus provided by this invention a new and novel high pressure electric discharge lamp having enhanced starting characteristics and improved lumen performance when compared with similar lamps not utilizing the invention.

While there have been shown and described what are at present considered to be the preferred embodiments of the invention, it will be apparent to those skilled in the art that various changes and modifications can be made herein without departing from the scope of the invention as defined by the appended claims.

We claim:

1. In a high pressure electric discharge lamp including an outer envelope containing an inert atmosphere, an arc discharge tube mounted within said outer envelope, said arc discharge tube containing first and second spaced apart main electrodes and an ionizable medium, the improvement comprising: means within said lamp for reducing the starting voltage of said lamp by an average of about 50% after said lamp has aged about 4000 hours, said means comprising at least one starting probe positioned in said arc tube, said starting probe being adjacent only one of said main electrodes, and being electrically isolated at all times from any ohmic contact with any other electrode of said lamp and from any ohmic contact or capacitive contact from associated ballast circuitry.

2. The lamp of claim 1 wherein said probe is tantalum.

3. The lamp of claim 1 wherein said ionizable medium comprises substantially argon with an effective amount of mercury.

4. The lamp of claim 3 wherein said inert atmosphere is nitrogen.

* * * * *